US007117147B2

(12) United States Patent
Boillot et al.

(10) Patent No.: US 7,117,147 B2
(45) Date of Patent: Oct. 3, 2006

(54) METHOD AND SYSTEM FOR IMPROVING VOICE QUALITY OF A VOCODER

(75) Inventors: Marc A. Boillot, Plantation, FL (US); Ali Behboodian, Natick, MA (US); Pratik V. Desai, Boca Raton, FL (US)

(73) Assignee: Motorola, Inc., Schaumburg, IL (US)

( * ) Notice: Subject to any disclaimer, the term of this patent is extended or adjusted under 35 U.S.C. 154(b) by 125 days.

(21) Appl. No.: 10/900,736

(22) Filed: Jul. 28, 2004

(65) Prior Publication Data

US 2006/0025990 A1 Feb. 2, 2006

(51) Int. Cl.
*G10L 11/14* (2006.01)

(52) U.S. Cl. ..... 704/207; 704/229; 704/230

(58) Field of Classification Search ..... 704/207, 704/229, 230

See application file for complete search history.

(56) References Cited

U.S. PATENT DOCUMENTS 5,664,055 A * 9/1997 Kroon ..... 704/223
5,933,808 A * 8/1999 Kang et al. ..... 704/278
5,953,696 A * 9/1999 Nishiguchi et al. ..... 704/209
5,960,386 A * 9/1999 Janiszewski et al. ..... 704/207
6,336,092 B1 1/2002 Gibson et al.
6,418,407 B1 * 7/2002 Huang et al. ..... 704/207
6,526,376 B1 * 2/2003 Villette et al. ..... 704/207
6,549,884 B1 4/2003 Laroche et al.
6,691,082 B1 * 2/2004 Aguilar et al. ..... 704/219
2003/0065506 A1 * 4/2003 Adut ..... 704/207

* cited by examiner

*Primary Examiner*—Richemond Dorvil
*Assistant Examiner*—Qi Han
(74) *Attorney, Agent, or Firm*—Larry G. Brown

(57) ABSTRACT

The invention concerns a method (300) and system (100) for improving voice quality of a vocoder (138, 158). The method includes the steps of monitoring (312) a pitch of a voice signal (400) at a transmitting unit (110); when the pitch of the voice signal reaches a predetermined threshold (840), shifting (326) the pitch of the voice signal to at least a portion of a predetermined range (810); transmitting (338) the pitch-shifted voice signal to a receiving unit (112); and at the receiving unit, reshifting (342) the pitch-shifted voice signal to a level that compensates the step of shifting the pitch of the voice signal at the transmitting unit.

36 Claims, 6 Drawing Sheets

METHOD AND SYSTEM FOR IMPROVING VOICE QUALITY OF A VOCODER

BACKGROUND OF THE INVENTION

1. Field of the Invention

This invention relates in general to methods and systems that transmit and receive audio and more particularly, that rely on multiband excitation vocoders to do so.

2. Description of the Related Art

In recent years, portable electronic devices, such as cellular telephones and personal digital assistants, have become commonplace. Many of these devices include a vocoder, such as a multiband excitation (MBE) vocoder. An MBE vocoder is a device that converts analog speech waveforms from various individuals into digital signals. These digital signals are then typically transmitted to another portable electronic device, where they are decoded and broadcast through a speaker to a user of the receiving portable electronic device.

Many MBE vocoders, however, have a limited encoding range. For example, most MBE vocoders are only able to encode speech waveforms that have pitch values between 80 Hz and 500 Hz. The range is limited because the vocoder is provided with a relatively small number of bits to cover the whole spectrum of pitch values generated by the different types of user voices (only a small number of bits are provided to preserve bandwidth).

Generally, the limited range is suitable for encoding the many different types of user voices. The pitch values of certain voice types, however, may exceed the encoding range of the vocoder. For example, the pitch values of the voice of a woman or a small child may surpass this range, particularly if the woman or small child is in an excited state. That is, the pitch inflections of certain individuals may exceed an allowable pitch range. In this instance, the vocoder cannot properly encode the speech waveforms, which will result in a degradation of voice quality.

SUMMARY OF THE INVENTION

The present invention concerns a method for improving voice quality of a vocoder. The method includes the steps of monitoring a pitch of a voice signal; at a transmitting unit, when the pitch of the voice signal reaches a predetermined threshold, shifting the pitch of the voice signal to at least a portion of a predetermined range; transmitting the pitch-shifted voice signal to a receiving unit; and at the receiving unit, reshifting the pitch-shifted voice signal to a level that compensates the step of shifting the pitch of the voice signal at the transmitting unit.

As an example, the voice signal can be comprised of a plurality of time-based frames. In one arrangement, the monitoring the pitch step includes the steps of estimating the pitch of the voice signal for at least a portion of the time-based frames of the voice signal and based on the estimating step, generating a pitch contour of the voice signal. In another arrangement, the voice signal can be comprised of voiced and unvoiced portions. Additionally, the generating the pitch contour step can include the step of interpolating the pitch contour for the unvoiced portions of the voice signal.

The method can also include the steps of, in the transmitting unit, detecting speech on the voice signal and when detecting speech on the voice signal, determining whether the speech is comprised of voiced and unvoiced portions.

Also, if no speech is detected on the voice signal, the method can further include the step of inserting silence frames into the voice signal. The method can also include the step of converting at least a portion of the silence frames to pitch frames. The pitch frames can signal the receiving unit that the pitch-shifted voice signal was pitch shifted. The pitch frames can also signal the receiving unit of the magnitude that the pitch-shifted voice signal was shifted. As an alternative step, the pitch frames can be added to the voice signal.

The pitch of the voice signal can be shifted by either increasing or decreasing the pitch of the voice signal. The method can further include the steps of encoding the pitch-shifted voice signal at the transmitting unit, decoding the pitch-shifted voice signal at the receiving unit and detecting a voiced or an unvoiced condition on the voice signal. As an example, the predetermined threshold can be a compression window, and the predetermined range can be between the maximum encoding pitch level and the minimum encoding pitch level of the vocoder. As another example, the pitch of the voice signal can be shifted from a first level to the portion of the predetermined range. The pitch-shifted voice signal can be reshifted at the receiving unit to a second level that is at least substantially equal to the first level.

The present invention also concerns a system for improving voice quality of a vocoder. The system includes a pitch analysis section for monitoring a pitch of a voice signal, a pitch shifter coupled to the pitch analysis section, an encoding section coupled to the pitch shifter and a transmission section coupled to the encoding section. When the pitch analysis section determines that the pitch of the voice signal has reached a predetermined threshold, the pitch shifter shifts the pitch of the voice signal to at least a portion of a predetermined range. In addition, the encoding block encodes the voice signal and provides pitch-shifting information in the voice signal, and the transmission section transmits the pitch-shifted voice signal to a receiving unit. The receiving unit uses the pitch-shifting information to reshift the pitch-shifted voice signal to a level that compensates the pitch shifting performed by the pitch shifter. The system can also include suitable software and/or circuitry to carry out the processes described above.

The present invention also concerns a machine readable storage, having stored thereon a computer program having a plurality of code sections executable by a portable computing device. The code sections cause the portable computing device to perform the steps of monitoring a pitch of a voice signal; at a transmitting unit, when the pitch of the voice signal reaches a predetermined threshold, shifting the pitch of the voice signal to at least a portion of a predetermined range; and transmitting the pitch-shifted voice signal to a receiving unit. At the receiving unit, the pitch-shifted voice signal is reshifted to a level that compensates the step of shifting the pitch of the voice signal at the transmitting unit. The code sections can also cause the portable computing device to perform the steps described above.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION

Figure 1:
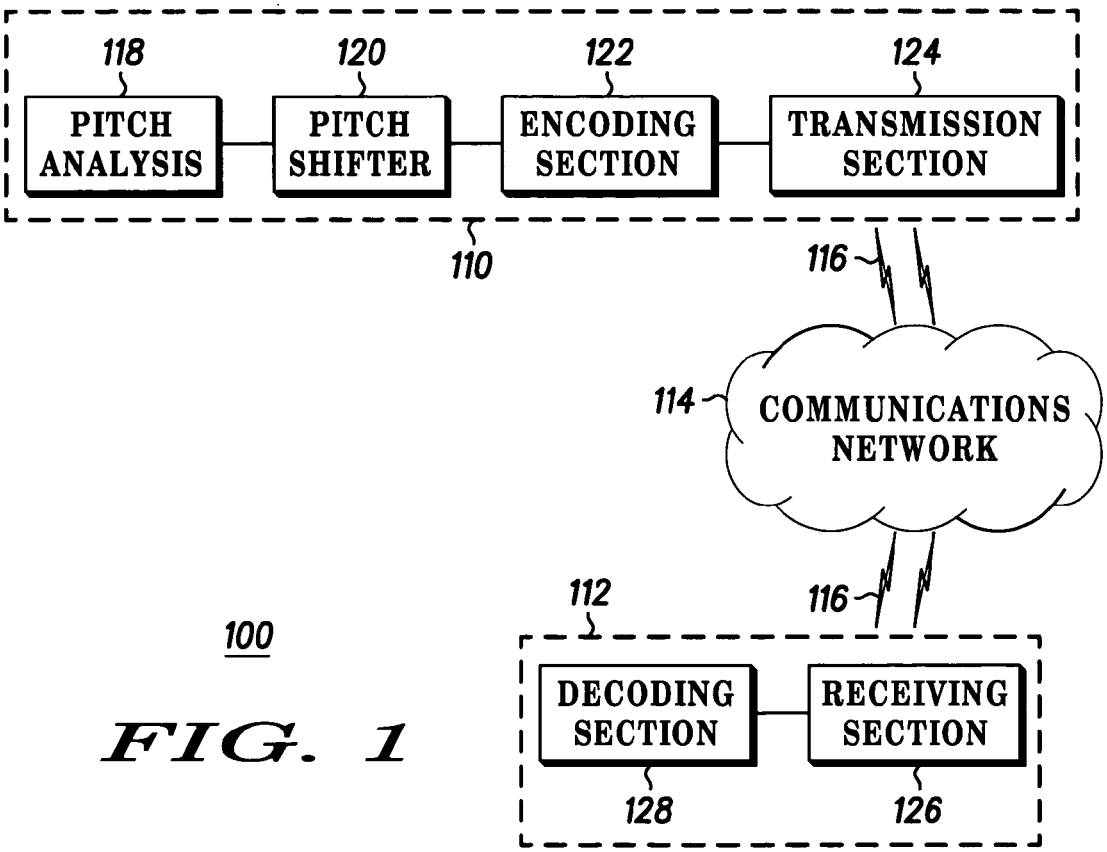
FIG. 1 illustrates a communication system in accordance with an embodiment of the inventive arrangements.

While the specification concludes with claims defining the features of the invention that are regarded as novel, it is believed that the invention will be better understood from a consideration of the following description in conjunction with the drawing figures, in which like reference numerals are carried forward.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

This invention presents a method and system for improving voice quality of a vocoder. For example, a transmitting unit can transmit a voice signal to a receiving unit. In the transmitting unit, a pitch analysis section can monitor the pitch of the voice signal, and when it reaches a predetermined threshold, a pitch shifter can shift the pitch of the voice signal to at least a portion of a predetermined range. The predetermined threshold can be a compression window. The pitch-shifted voice signal can be transmitted to the receiving unit. In the receiving unit, a decoding block can reshift the pitch-shifted voice signal to compensate for the pitch shifting that occurred in the transmitting unit.

Referring to FIG. 1, a communication system 100 is shown. The communication system 100 can include a transmitting unit 110 and a receiving unit 112. In one arrangement, the transmitting unit 110 can transmit audio, such as a voice signal, to the receiving unit 112 over a communications network 114. As an example, the transmitting unit 110 and the receiving unit 112 can communicate with one another through the communication network 114 using wireless communications links 116. It is understood, however, that the transmitting unit 110 and the receiving unit 112 can communicate with one another over hard-wired connections, as well. In addition, the transmitting unit 110 and the receiving unit 112 can communicate with one another without the assistance of a communications network.

It should also be noted that the transmitting unit 110 is not limited to transmitting signals and that the receiving unit 112 is not limited to receiving signals. These terms are merely meant to distinguish the transmitting unit 110 from the receiving unit 112. As such, the transmitting unit 110 can receive any suitable type of communications signals. Similarly, the receiving unit 112 can transmit any suitable type of communications signals. As an example, the transmitting unit 110 and the receiving unit 112 can be mobile communication units, such as cellular telephones, personal digital assistants, two-way radios, etc. Of course, the transmitting unit 110 can be any electronic device that is capable of at least encoding speech, and the receiving unit 112 can be any electronic device that is capable of at least decoding speech.

The transmitting unit 110 and the receiving unit 112 can also be referred to as portable computing devices, both of which can be loaded with a computer program having a plurality of code sections. These code sections can be executable by the portable computing devices 110, 112 for causing the portable computing devices 110, 112 to perform the inventive methods that will be described below.

In one arrangement, the transmitting unit 110 can include a pitch analysis section 118, a pitch shifter 120, an encoding section 122 and a transmission section 124. The pitch analysis section 118 can be coupled to the pitch shifter 120, which can be coupled to the encoding section 122. Additionally, the encoding section 122 can be coupled to the transmission section 124. The receiving unit 112 can include a receiving section 126 and a decoding section 128 in which the receiving section 126 can be coupled to the decoding section 128.

Briefly, the pitch analysis section 118 can monitor the pitch of a voice signal in the transmitting unit 110. A voice signal may or may not contain speech. When the pitch analysis section 118 determines that the pitch of the voice signal has reached a predetermined threshold, the pitch shifter 120 can shift the pitch of the voice signal to at least a portion of a predetermined range. The encoding section 122 can encode the voice signal, and the transmission section 124 can transmit the voice signal to the receiving unit 112.

At the receiving unit 112, the receiving section 126 can receive the voice signal. Additionally, the decoding section 128 can reshift the pitch-shifted voice signal to a level that compensates the pitch shifting performed by the pitch shifter 120. The decoding section 128 can also decode the voice signal. Those of skill in the art will appreciate, however, that the transmitting unit 110 and the receiving unit 112 can include other suitable components for performing many other functions.

Figure 2:
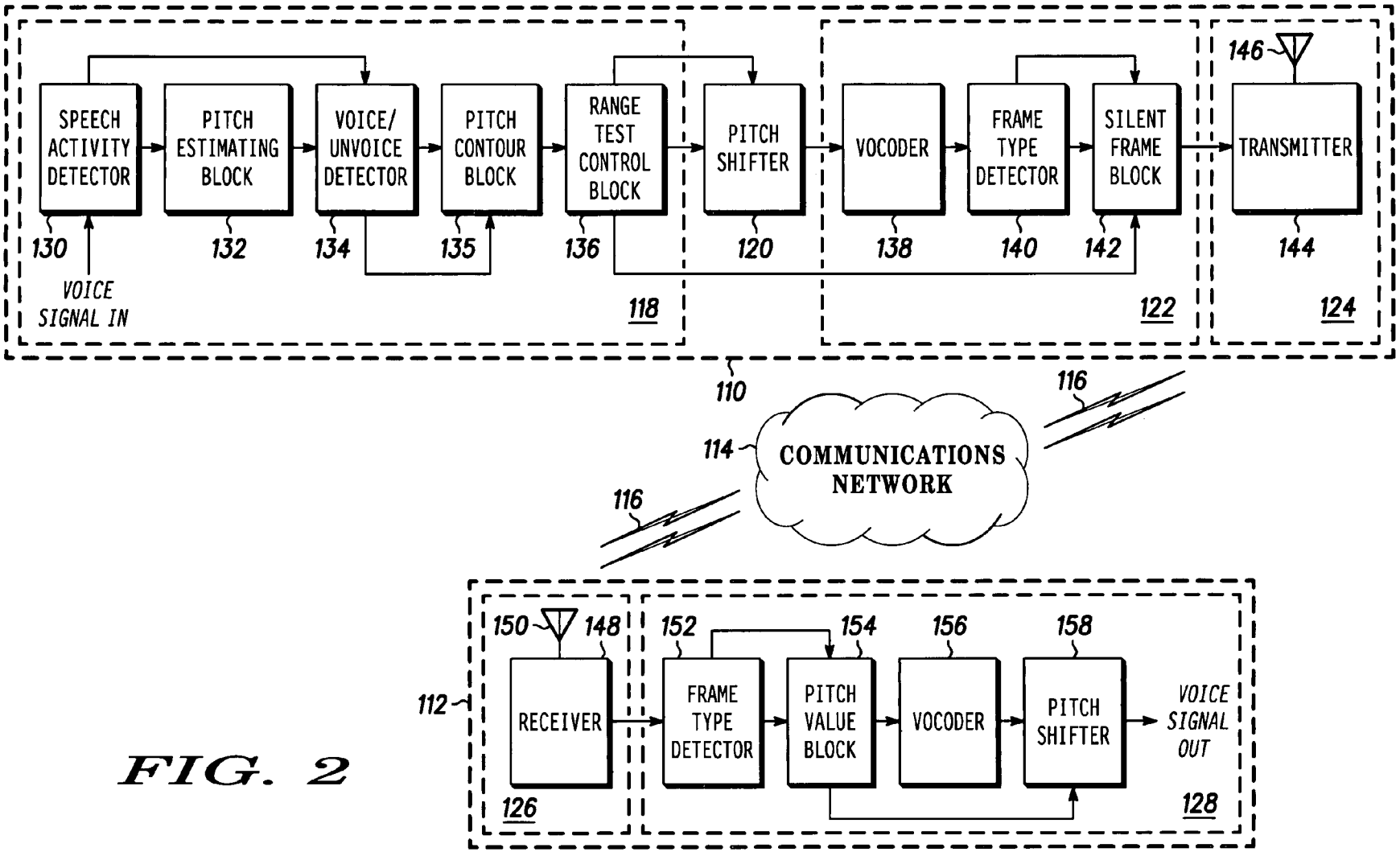
FIG. 2 illustrates the communication system of FIG. 1 in greater detail in accordance with an embodiment of the inventive arrangements.

Referring to FIG. 2, a more detailed block diagram of the transmitting unit 110 and the receiving unit 112 is shown. In one arrangement, the pitch analysis section 118 can include a speech activity detector 130 that can receive a voice signal, a pitch estimating block 132, a voiced/unvoiced detector 134, a pitch contour block 135 and a range test control block 136. The voice signal can be divided into a plurality of time-based frames. The speech activity detector 130 can be coupled to the pitch estimating block 132 and can detect speech activity on the incoming voice signal. The pitch estimating block 132 can be coupled to the voiced/unvoiced detector 134. The pitch estimating block 132 can estimate the pitch of the voice signal for at least a portion of the time-based frames of the voice signal.

The voiced/unvoiced detector 134 can be coupled to the pitch contour block 135 and can also have a signaling path to the pitch contour block 135. The speech activity detector 130 can also have a signaling path to the voiced/unvoiced detector 134. In one arrangement, the voiced/unvoiced detector 134 can detect voiced and unvoiced portions of speech that are on the voice signal, and the pitch contour block 135, based on the pitch estimation, can determine a pitch contour for the voice signal.

The pitch contour block 135 can be coupled to the range test control block 136, and the range test control block 136 can be coupled to the pitch shifter 120. The range test control block 136 can also have a signaling path to the pitch shifter 120. In one embodiment of the invention, the range test control block 136 can determine when the pitch contour of the voice signal reaches a predetermined threshold. When the pitch contour does so, the range test control block 136 can signal the pitch shifter 120. As will be explained later, the pitch shifter 120 can shift the pitch of the voice signal into at least a portion of a predetermined range.

The encoding section 122 can include a vocoder 138, a frame type detector 140 and a silent frame block 142. The pitch shifter 120 can be coupled to the vocoder 138, and the vocoder 138 can be coupled to the frame type detector 140. The vocoder 138 can encode the voice signal, such as by generating frames. The frame type detector 140 can be coupled to the silent frame block 142, and the frame type detector 140 can also have a signaling path to the silent frame block 142. As an example, the frame type detector 140 can detect the frames that the vocoder 138 generates and can selectively signal the silent frame block 142 based on the presence of certain frames. The range test control block 136 can also have a signaling path to the silent frame block 142 to permit the range test control block 136 to signal the silent frame block 142 when the range test control block 136 determines that the pitch contour of the voice signal has reached the predetermined threshold.

In one arrangement, when signaled by the range test control block 136 and the frame type detector 140, the silent frame block 142 can convert silent frames in the voice signal to pitch frames. Alternatively, when the silent frame block 142 is signaled, the silent frame block 142 can add pitch frames to the voice signal. These processes will be explained further below.

The transmission block 124 can include a transmitter 144 and an antenna 146 in which the transmitter 144 is coupled to the antenna 146. The silent frame block 142 can also be coupled to the transmitter 144. The transmission block 124, as those of skill in the art will appreciate, can transmit the voice signal to another communication device, such as the receiving unit 112.

Turning to the receiving unit 112, the receiving section 126 can include a receiver 148 and an antenna 150 in which the receiver 148 is coupled to the antenna 150. The antenna 150 can capture any voice signals transmitted from the transmitting unit 110, and the receiver 148 can process the voice signal in accordance with well-known principles. In one arrangement, the decoding block 128 can include a frame type detector 152, a pitch value block 154, a vocoder 156 and a pitch shifter 158. The frame type detector 152 can detect the type of frames that are in the incoming voice signal and can be coupled to the receiver 148 and the pitch value block 154. The frame type detector 152 can also have a signaling path to the pitch value block 154. The pitch value block 154, when signaled by the frame type detector 152, can determine the magnitude of the pitch shifting that occurred in the transmitting unit 110. The pitch value block 154 can also be coupled to the vocoder 156 and can include a signaling path to the pitch shifter 158.

The vocoder 156 can be coupled to the pitch shifter 158 and can decode the pitch-shifted voice signal. When signaled with the pitch-shifting information by the pitch value block 154, the pitch shifter 158 can reshift the pitch of the voice signal to compensate for the pitch shifting that occurred in the transmitting unit 110. The pitch shifter 158 can also output the voice signal to any other suitable components in the receiving unit 112.

Figure 3:
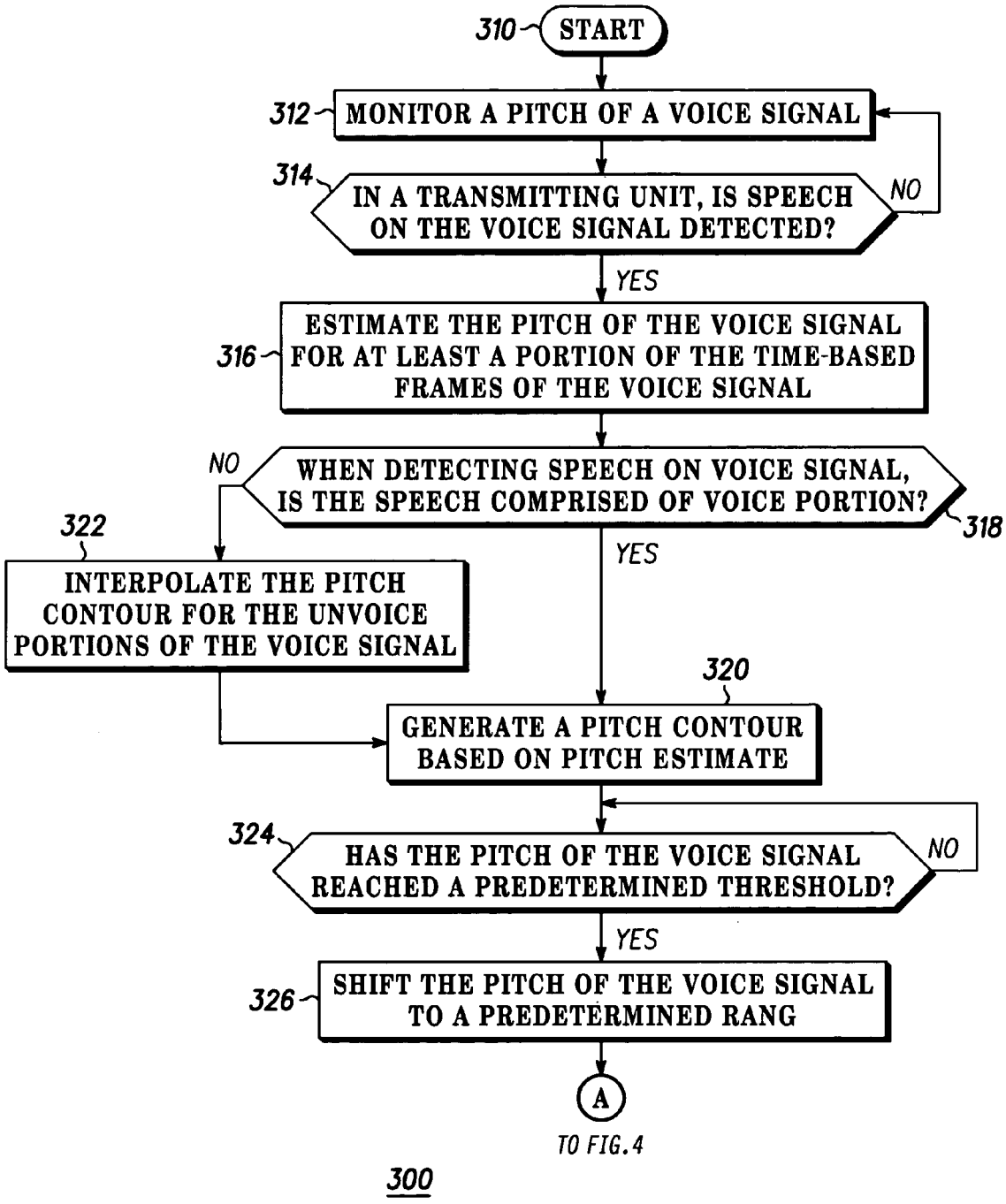
FIG. 3 illustrates a portion of a method for improving voice quality of a vocoder in accordance with an embodiment of the inventive arrangements.

Referring to FIG. 3, a method 300 for improving voice quality of a vocoder is shown. When describing the method 300, reference will be made to FIG. 2, although it must be noted that the method 300 can be practiced in any other suitable system or device. Moreover, the steps of the method 300 are not limited to the particular order in which they are presented in FIG. 3. The inventive method can also have a greater number of steps or a fewer number of steps than those shown in FIG. 3. In one particular example, the vocoder 138 that will be described in reference to this example can have a minimum encoding pitch frequency of 80 Hz and a maximum encoding pitch frequency of 500 Hz. Moreover, an exemplary operating ceiling for the vocoder 138 can be 750 Hz. It must be noted, however, that the invention is not limited to these particular values.

At step 310, the method 300 can start. At step 312, a pitch of a voice signal can be monitored. One way to monitor the pitch of the voice signal is shown in steps 314–324. For example, at decision block 314, in a transmitting unit, it can be determined whether speech is present on the voice signal. If speech is not present, then the method 300 can resume at step 312. If speech is present, at step 316, the pitch of the voice signal can be estimated for at least a portion of the time-based frames of which the voice signal is comprised. At decision block 318, it can be determined whether the speech on the voice signal is comprised of a voiced portion. If it is, a pitch contour can be generated for the voice signal based on the pitch estimating step 316, as shown at step 320. If unvoiced portions are present in the speech, then a pitch contour for the unvoiced portions of the voice signal can be generated by interpolation, as shown at step 322. At decision block 324, it can then be determined whether the generated pitch contour of the voice signal has reached a predetermined threshold.

For example, referring to FIG. 2, the pitch analysis block 118 can monitor the pitch of a voice signal. Specifically, the speech activity detector 130 in the transmitting unit 110 can detect speech on the voice signal. The term speech can include any spoken words whether they are generated by a living being or a machine. If speech is detected, the speech activity detector 130 can signal the voiced/unvoiced detector 134. An example of detected speech 410 of a voice signal 400 is illustrated in FIG. 5.

The pitch estimating block 132 (see FIG. 2) can estimate the pitch of the voice signal 400 for at least a portion of time-based frames of the voice signal 400. For example, the voice signal 400 can be divisible into a plurality of time-based frames. As is known in the art, because a person's vocal cords vibrate with a certain fundamental frequency, the resulting waveform can be characterized as a periodic signal. As a result, for at least a portion of these frames, the pitch estimating block 132 can estimate the periodicity of the voice signal 400. Referring to FIG. 6, a time-based frame vs. pitch graph showing a pitch estimate (or pitch track) 500 for the detected speech 410 of FIG. 5 is shown The pitch estimating block 132 (see FIG. 2) can use various methods to estimate the periodicity of the voice signal 400 for the frames, including both time and frequency analyses. As an example of a time analysis, the pitch estimating block 132 can employ an autocorrelation analysis, also known as the maximum likelihood method, for pitch estimation. As is known in the art, autocorrelation analysis reveals the degree to which a signal is correlated with itself, which reveals the fundamental pitch period. Alternatively, the pitch estimating block 132 can assess the zero crossing rate of the voice signal. This well-known principle can determine the periodicity, as the fundamental frequency is periodic and cycles around an origin level. If a frequency analysis is desired, the pitch estimating block 132 can rely on techniques like harmonic product spectrum or multi-rate filtering, both of which use the harmonic frequency components of the voice signal 400 to determine the fundamental pitch frequency.

Figure 5:
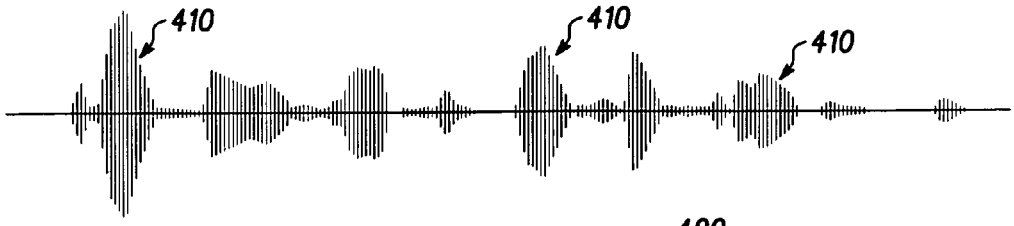
FIG. 5 illustrates an example of a voice signal in accordance with an embodiment of the inventive arrangements.
Figure 6:
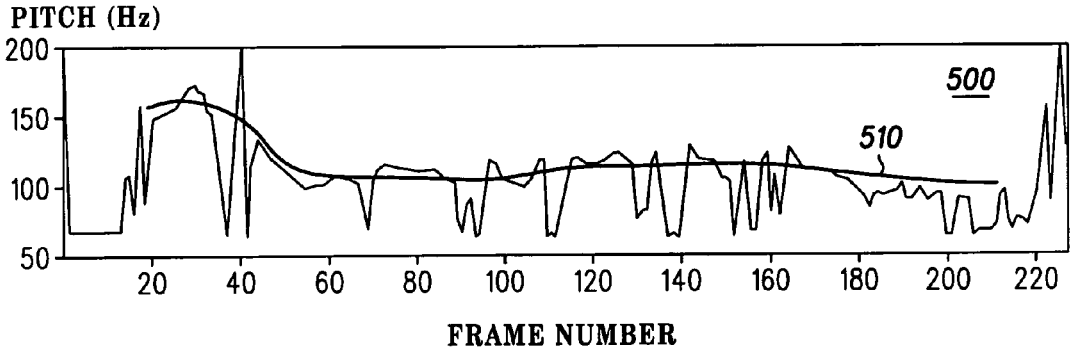
FIG. 6 illustrates a pitch estimate and a pitch contour for the voice signal of FIG. 4 in accordance with an embodiment of the inventive arrangements.

Referring to FIGS. 2, 5 and 6, following pitch estimation, the voiced/unvoiced detector 134 can determine which parts of the detected speech 410 are voiced portions and which parts are unvoiced portions. For purposes of the invention, the voiced portion of the voice signal 400 can be that part of the voice signal 400 that includes a periodic component of the voice signal 400. This phenomena is generally produced when vowels are spoken as a result of vocal chord vibration. In contrast, the unvoiced portion of the voice signal 400 can be that part of the voice signal 400 that includes non-periodic components. The unvoiced portion of the voice signal 400 is typically produced when consonants are spoken. The voiced/unvoiced detector 134 can detect the voiced and unvoiced portions of the detected speech 410 of the voice signal 400 and can signal the pitch contour block 135. To detect the voiced and unvoiced portions, the voiced/unvoiced detector 134 can use any of a number of well-known algorithms.

Using the pitch estimate 500, the pitch contour block 135 can generate a pitch contour 510 (see FIG. 6) for both the voiced and unvoiced portions of the detected speech 410 of the voice signal 400, as those of skill in the art will appreciate. In one arrangement, the pitch contour block 135 can generate the pitch contour 510 of the unvoiced portions of the voice signal 400 using interpolation, as is known in the art. The pitch contour 510 can serve as a running pitch average for the voice signal 400.

Figure 7:
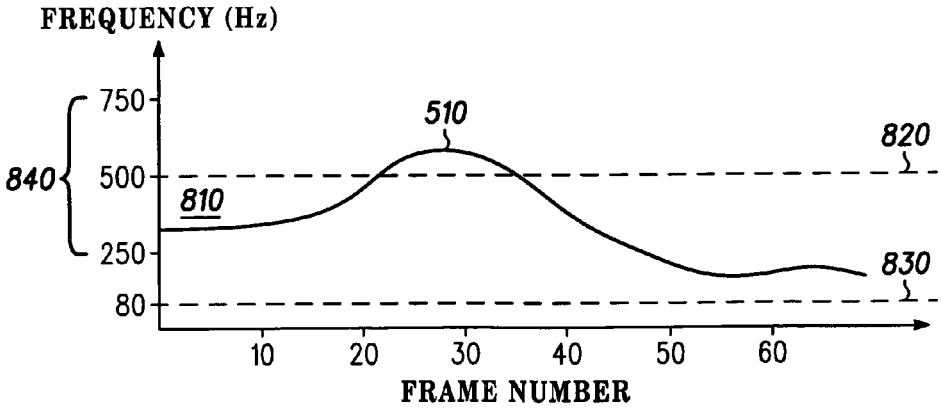
FIG. 7 illustrates a graph of an example of a pitch contour in accordance with an embodiment of the inventive arrangements.

The range test control block 136 can determine when a pitch contour of a voice signal reaches a predetermined threshold. Determining when a pitch contour reaches a predetermined threshold can also be referred to as determining when the pitch itself reaches the predetermined threshold. Referring to FIG. 7, a graph 800 having a pitch contour 510 is shown. The pitch contour 510 as illustrated has not undergone any pitch shifting. A predetermined range 810 that is bounded by broken lines is also illustrated. The predetermined range 810 can be the operating range of the vocoder 138 (see FIG. 2), or the area between a maximum encoding pitch level 820 and a minimum encoding pitch level 830 of the vocoder 138. The predetermined range 810, however, can be any other suitable parameter for any other suitable unit.

In this example, the maximum encoding pitch level 820 of the vocoder 138 can be 500 Hz, and the minimum encoding pitch level 830 of the vocoder 138 can be 80 Hz. It is understood, however, that the above values are merely examples, as the vocoder 138 can have any other suitable maximum and minimum encoding pitch levels. In any event, for this example, it can be seen that the pitch contour 510 has exceeded the maximum encoding pitch level 820, which can lead to degradation in voice quality. This result may be caused by, for example, the speech of a woman or child with high pitch.

As an example, the predetermined threshold can be a compression window 840, a range of frequencies where compression of the pitch of a voice signal may occur. In this particular example, the compression window 840 can have a range from 250 Hz to 750 Hz. In accordance with an embodiment of the inventive arrangements, when the pitch contour 510 reaches the compression window 840, the range test control block 136 can determine that the pitch has reached the predetermined threshold. Of course, other values can be used for the compression window 840.

In one arrangement, the range test control block 136 (see FIG. 2) can monitor the pitch contour 510 at predetermined intervals. For example, the range test control block 136 can monitor the pitch contour 510 in accordance with a predetermined frame, such as monitoring the pitch contour 510 at every tenth frame, although it is within the inventive arrangements to monitor the pitch contour 510 on a continuous basis, if so desired. As shown in the graph 800, the pitch contour 510 reaches the compression window 840 at around frame 10 and remains in the compression window 840 until roughly frame 50. As will be explained below, when the pitch contour 510 is within the compression window 840, the pitch of the voice signal 400 (see FIG. 5) can be shifted or compressed. This shifting or compression can help keep the pitch contour 510 in the predetermined range 810.

Referring back to the method 300 of FIG. 3, at decision block 324, if the pitch of the voice signal has not reached the predetermined threshold, the method 300 can resume again at the decision block 324. Conversely, if the pitch of the voice signal has reached the predetermined threshold, the method 300 can continue at step 326. At step 326, the pitch of the voice signal can be shifted to a predetermined range. The pitch-shifted voice signal can be encoded at the transmitting unit, as shown at step 328 of FIG. 4, through jump circle A.

For example, referring once again to FIG. 2 and FIG. 7, once it determines that the pitch contour 510 has reached the predetermined threshold, i.e., the compression window 840, the range test control block 136 can signal the pitch shifter 120. As will be explained later, the range test control block 136 can also signal the silent frame block 142. In response, the pitch shifter 120 can shift the pitch of the voice signal 400 to at least a portion of the predetermined range 810.

Figure 8:
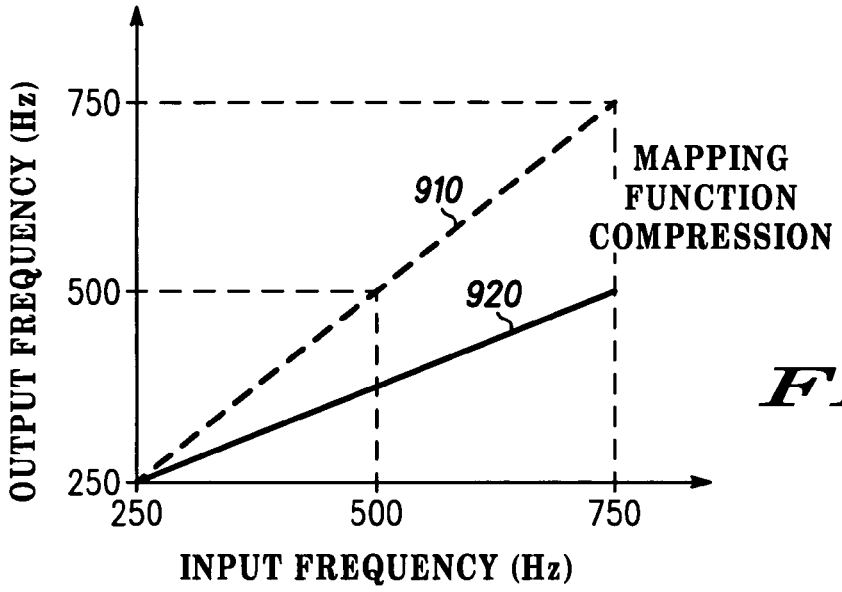
FIG. 8 illustrates a mapping function compression table in accordance with an embodiment of the inventive arrangements.

To shift the pitch of the voice signal 400 (and hence the pitch contour 510), the pitch shifter 120 can use any suitable compression algorithm. One particular example of a mapping function compression table 900 that the pitch shifter 120 can utilize to shift the pitch is shown in FIG. 8. The dashed line 910 represents a one-to-one correspondence between an input and an output, and the solid line 920 represents a suitable compression scheme. Referring to FIGS. 2 and 7, when the pitch contour 510 reaches the compression window 840, the pitch shifter 120 can decrease the pitch of the voice signal 400 using the compression scheme shown in the mapping function compression table 900 of FIG. 8.

Figure 9:
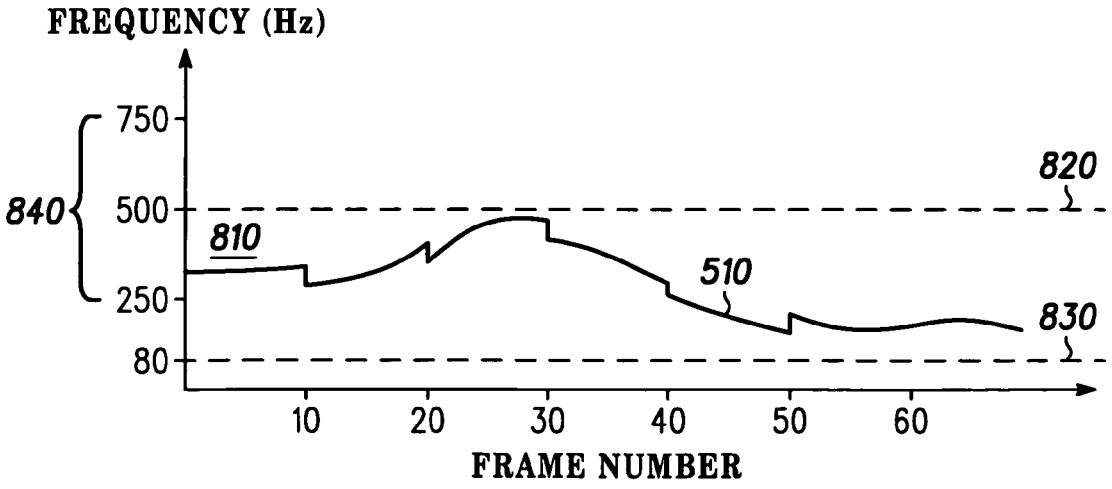
FIG. 9 illustrates a graph of the pitch contour of FIG. 7 after the pitch contour has been pitch shifted in accordance with an embodiment of the inventive arrangements.

Referring to FIG. 9, a graph 1000 showing a pitch-shifted pitch contour 510 is illustrated. To describe this graph 1000, reference will be made to FIGS. 2, 7 and 8. As explained earlier, the range test control block 136 can monitor the pitch contour 510 at predetermined intervals, such as at every tenth frame. In this case, the range test control block 136 can determine that the pitch contour 510 has reached the compression window 840 at the tenth frame. Specifically, the range test control block 136 can determine that the pitch contour 510, at the tenth frame (see FIG. 7), has a value of roughly 310 Hz. The range test control block 136 can then signal the pitch shifter 120. In response, the pitch shifter 120, using the compression scheme of the mapping function compression table 900, can decrease the pitch from a first level of 310 Hz to a value of roughly 285 Hz (see frame 10 of FIG. 9). In one arrangement, this decrease of roughly 25 Hz can be linear in nature and can apply to all the frames until the next interval. For example, this downward shift in pitch is shown from frame 10 to frame 19 of the graph 1000.

Continuing with the example, the range test control block 136 can determine that the pitch contour 510 has a pitch value of about 475 Hz (see frame 20 in FIG. 7) and can signal the pitch shifter 120 once again. Using the mapping function compression table 900, the pitch shifter 120 can decrease by approximately 115 Hz the pitch value of the pitch contour 510, which would put it at around 360 Hz (see frame 20 in FIG. 9). This pitch shift may also be linear and can apply to all the frames from frame 20 to frame 29, as seen in graph 1000 of FIG. 9. A similar process can occur for the frames from frame 30 to frame 49, in which the pitch for the pitch contour 510 is decreased by about 195 Hz between frames 30 and 39 (see FIG. 9) and roughly 65 Hz between frames 40 and 49 (see FIG. 9).

When the range test control block 136 checks the pitch contour 510 at frame 50 of FIG. 7, it can determine that the pitch has fallen out of the compression window 840. At this point, pitch shifting is no longer necessary, and the range test control block 136 can signal the pitch shifter 120 to stop pitch shifting. The pitch contour 510 of FIG. 9 can now track the pitch contour 510 of FIG. 7. As can be seen in FIG. 9, the pitch shifting process can keep the pitch contour 510 within at least a portion of the predetermined range 810, which can help the vocoder 138 efficiently encode the voice signal 400.

It must be noted that the description above is merely one example of how to do pitch shifting. Those of skill in the art will appreciate that there are many different ways to modify the pitch of a voice signal. Moreover, it must be stressed that pitch shifting a voice signal is not limited to decreasing the pitch; that is, the pitch of a voice signal may also be increased in accordance with the example above to help keep the voice signal within the encoding range of a vocoder. It is also understood that the compression shown above is not limited to being performed in a linear fashion, as non-linear pitch shifting can be employed in accordance with the inventive arrangements. Once the voice signal 400 has been shifted, the vocoder 138 can encode the pitch-shifted voice signal 400. The process of encoding a voice signal is well known in the art, and a description here is not necessary. At this point, the voice signal 400 may be considered an audio signal, although it will continue to be referred to as a voice signal for purposes of clarity.

Figure 4:
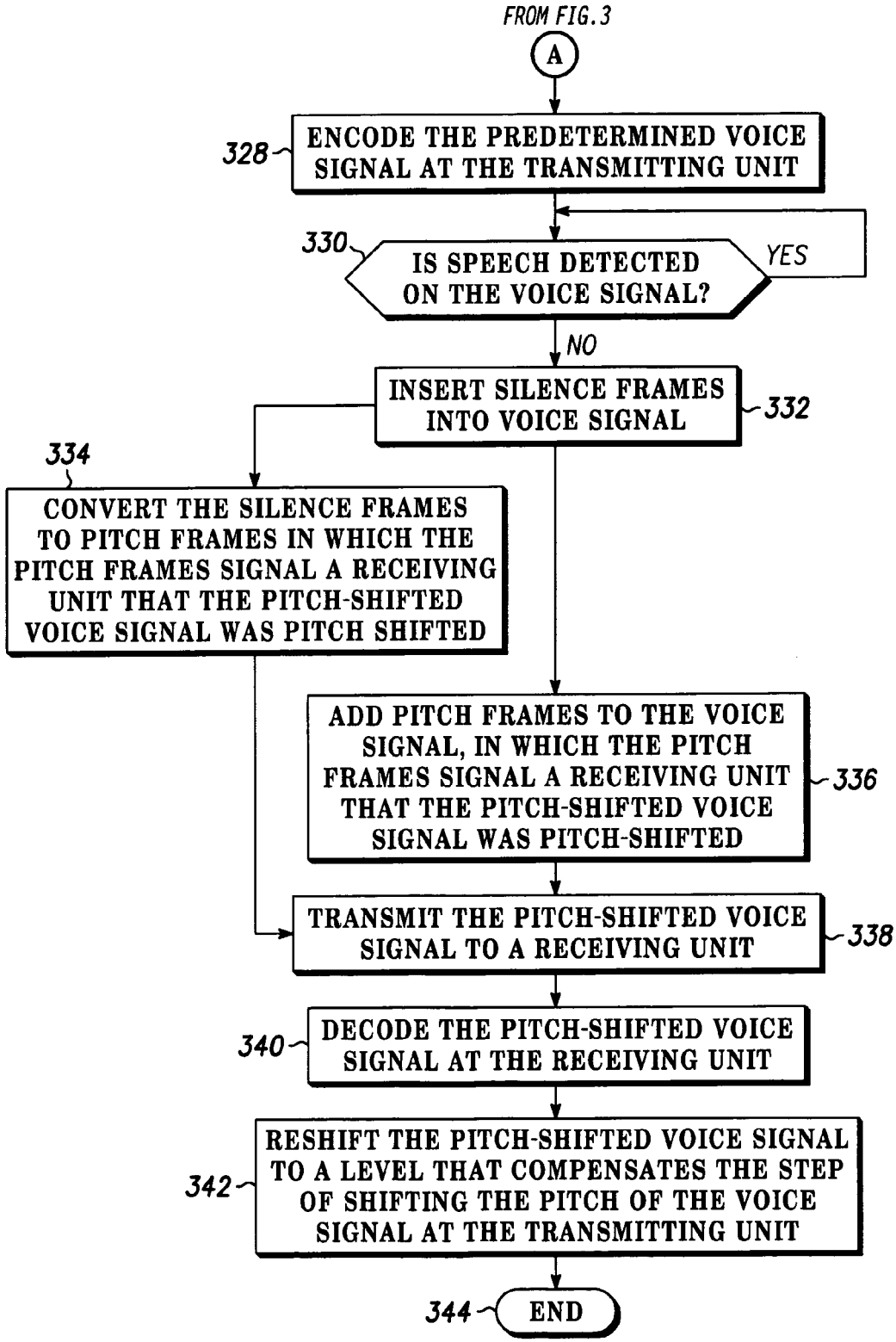
FIG. 4 illustrates another portion of the method for improving voice quality of a vocoder of FIG. 3 in accordance with an embodiment of the inventive arrangements.

Referring back to the method 300 of FIG. 4, it can be determined whether speech is detected on the voice signal, as shown at decision block 330. If it is, the method 300 can resume at decision block 330. If it is not, the method 300 can resume at step 332, where silence frames can be inserted into the voice signal. The silence frames can be inserted into the voice signal in several ways. For example, at step 334, the silence frames can be converted to pitch frames, or pitch frames can be added to the voice signal, as shown at step 336. In either arrangement, the pitch frames can signal a receiving unit that the pitch-shifted voice signal was pitch shifted. At step 338, the pitch-shifted voice signal can be transmitted to a receiving unit.

For example, referring to FIG. 2, as is known in the art, when the vocoder 138 detects no speech activity on the voice signal 140, the vocoder 138 can enter a discontinuous transmission mode to reduce transmission bandwidth. Specifically, the vocoder 138 can generate comfort noise frames, also referred to as silent frames, and can insert these silent frames into the voice signal 400. The frame type detector 140 can detect these silent frames in the voice signal 400 and can signal the silent frame block 142.

As noted earlier, when the range test control block 136 determines that the pitch of the voice signal 400 has reached the predetermined threshold, the range test control block 136 can also signal the silent frame block 142. Based on this signaling, the silent frame block 142 can determine the amount of pitch shifting to be performed by the pitch shifter 120. This signaling can also be received from the pitch shifter 120, if so desired.

After receiving these signals, the silent frame block 142 can, for example, convert one or more of the silent frames in the voice signal 400 to pitch frames. Alternatively, the silent frame block 142 can add one or more pitch frames to the voice signal, leaving the silent frames in place. The pitch frames can include pitch-shifting information, such as data that can inform the receiving unit 112 that the incoming voice signal 400 has been pitch shifted. The data can also inform the receiving unit 112 of the magnitude of the pitch shifting that was performed in the transmitting unit 110. Once the pitch frames have been inserted in the voice signal 400, the transmitter 144 can transmit the voice signal 400 through the antenna 146 to the receiving unit 112.

Sending the pitch-shifting information in the fashion described above can minimize any interruption to the voice signal 400 without seriously affecting the amount of data that must be transmitted. Even so, the invention is not limited in this regard, as the pitch-shifting information can be transmitted to a receiving unit at any other suitable time. In addition, other scenarios for inserting the pitch-shifting information into the voice signal 400 are within contemplation of the inventive arrangements.

Referring once again to the method 300 of FIG. 4, at step 340, the pitch-shifted voice signal can be decoded at the receiving unit. Further, the pitch-shifted voice signal can be reshifted to a level that can compensate the step of shifting the pitch of the voice signal at the transmitting unit, as shown at step 342. Finally, the method 300 can end at step 344.

As an example, referring to FIG. 2, the antenna 150 of the receiving unit 112 can receive the transmitted, pitch-shifted voice signal 400. In accordance with well-known principles, the receiver 148 can process the pitch-shifted voice signal and can transfer it to the frame type detector 152 of the decoding block 128. In one arrangement, the frame type detector 152 can detect the presence of the pitch frames in the voice signal 400 and can signal the pitch value block 154. In response, the pitch value block 154 can extract the pitch-shifting information from the pitch frames, and it can signal the pitch shifter 158 with this data.

The vocoder 156 can decode the incoming voice signal 400. Because the voice signal 400 can remain pitch-shifted at this point, the pitch of the voice signal 400 can be within the decoding parameters of the vocoder 156. As a result, the vocoder 156 can efficiently decode the voice signal 400. Once the voice signal 400 is decoded, the pitch shifter 158—because it is signaled with the pitch-shifting information from the pitch value block 154—can reshift the pitch of the voice signal 400 to compensate for the pitch shifting that occurred in the transmitting unit 110.

As an example, the pitch shifter 158 can reshift the pitch of the voice signal 400 to a second level, and the second level can be at least substantially equal to the first level to which the pitch was originally shifted. For purposes of the invention, the phrase "substantially equal to" can include exact equality or even slight or moderate deviations thereform. Of course, the invention is not limited in this regard, as the pitch shifter 158 can reshift the pitch of the voice signal 400 to any suitable lower or even higher pitch value. Following pitch shifting, the voice signal 400 can be transferred to any other suitable components in the receiving unit 112.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method for improving voice quality of a vocoder, comprising the steps of:

monitoring a pitch of a voice signal;

at a transmitting unit, when the pitch of the voice signal reaches a predetermined threshold, shifting the pitch of the voice signal to at least a portion of a predetermined range;

transmitting the pitch-shifted voice signal to a receiving unit; and at the receiving unit, reshifting the pitch-shifted voice signal to a level that compensates the step of shifting the pitch of the voice signal at the transmitting unit.

2. The method according to claim 1, wherein the voice signal is comprised of a plurality of time-based frames and wherein the monitoring the pitch step comprises the steps of:

estimating the pitch of the voice signal for at least a portion of the time-based frames of the voice signal; and based on the estimating step, generating a pitch contour of the voice signal.

3. The method according to claim 2, wherein the voice signal is comprised of voiced and unvoiced portions and wherein the generating the pitch contour step comprises the step of interpolating the pitch contour for the unvoiced portions of the voice signal.

4. The method according to claim 1, further comprising the steps of:

in the transmitting unit, detecting speech on the voice signal; and when detecting speech on the voice signal, determining whether the speech is comprised of voiced and unvoiced portions.

5. The method according to claim 1, wherein if no speech is detected on the voice signal, the method further comprises the step of inserting at least one silence frame into the voice signal.

6. The method according to claim 5, further comprising the step of converting at least one of the silence frames to pitch frames, wherein the pitch frames signal the receiving unit that the pitch-shifted voice signal was pitch shifted.

7. The method according to claim 6, wherein the pitch frames further signal the receiving unit of the magnitude that the pitch-shifted voice signal was shifted.

8. The method according to claim 5, further comprising the step of adding at least one pitch frame to the voice signal, wherein the pitch frames signal the receiving unit that the pitch-shifted voice signal was pitch shifted.

9. The method according to claim 8, wherein the pitch frames further signal the receiving unit of the magnitude that the pitch-shifted is to be reshifted.

10. The method according to claim 1, wherein the pitch of the voice signal is shifted by one of increasing and decreasing the pitch of the voice signal.

11. The method according to claim 1, further comprising the steps of:

encoding the pitch-shifted voice signal at the transmitting unit; and decoding the pitch-shifted voice signal at the receiving unit.

12. The method according to claim 1, further comprising the step of detecting at least one of a voiced and an unvoiced condition on the voice signal.

13. The method according to claim 1, wherein the predetermined threshold is a compression window and wherein the predetermined range is between the maximum encoding pitch level and the minimum encoding pitch level of the vocoder.

14. The method according to claim 1, wherein the pitch of the voice signal is shifted from a first level to the portion of the predetermined range and wherein the pitch-shifted voice signal is reshifted at the receiving unit to a second level that is at least substantially equal to the first level.

15. A method for improving voice quality of a vocoder, comprising the steps of:

generating a pitch contour of a voice signal;

monitoring the pitch contour of the voice signal;

at a transmitting unit, when the pitch contour reaches a predetermined threshold, shifting the pitch of the voice signal from a first level to at least a portion of a predetermined range;

transmitting the pitch-shifted voice signal to a receiving unit; and at the receiving unit, reshifting the pitch-shifted voice signal to a second level that is at least substantially equal to the first level.

16. A system for improving voice quality of a vocoder, comprising:

a pitch analysis section, wherein the pitch analysis section monitors a pitch of a voice signal;

a pitch shifter coupled to the pitch analysis section, wherein when the pitch analysis section determines that the pitch of the voice signal has reached a predetermined threshold, the pitch shifter shifts the pitch of the voice signal to at least a portion of a predetermined range;

an encoding section coupled to the pitch shifter, wherein the encoding block encodes the voice signal and provides pitch-shifting information in the voice signal; and a transmission section coupled to the encoding section, wherein the transmission section transmits the pitch-shifted voice signal to a receiving unit, wherein the receiving unit uses the pitch-shifting information to reshift the pitch-shifted voice signal to a level that compensates the pitch shifting performed by the pitch shifter.

17. The system according to claim 16, wherein the voice signal is comprised of a plurality of time-based frames and wherein the pitch analysis section comprises a pitch estimating block and a pitch contour block, wherein the pitch estimating block estimates the pitch of the voice signal for at least a portion of the time-based frames of the voice signal and the pitch contour block generates a pitch contour of the voice signal based on the pitch estimation.

18. The system according to claim 17, wherein the voice signal is comprised of voiced and unvoiced portions and wherein the pitch contour block interpolates the pitch contour for the unvoiced portions of the voice signal.

19. The system according to claim 16, wherein the pitch analysis section further comprises a speech activity detector and a voiced/unvoiced detector, wherein the speech activity detector detects speech on the voice signal and when the speech activity detector detects speech on the voice signal, the voiced/unvoiced detector determines whether the speech is comprised of voiced and unvoiced portions.

20. The system according to claim 16, wherein the encoding section comprises a silent frame block, wherein if no speech is detected on the voice signal, the silent frame block inserts at least one silence frame into the voice signal.

21. The system according to claim 20, wherein the silent frame block converts at least one of the silence frames to a pitch frame, wherein the pitch frames signal the receiving unit that the pitch-shifted voice signal was pitch shifted.

22. The system according to claim 21, wherein the pitch frames further signal the receiving unit of the magnitude that the pitch-shifted voice signal was shifted.

23. The system according to claim 20, wherein the silent frame block adds at least one pitch frame to the voice signal, wherein the pitch frames signal the receiving unit that the pitch-shifted voice signal was pitch shifted.

24. The system according to claim 23, wherein the pitch frames further signal the receiving unit of the magnitude that the pitch-shifted voice signal was shifted.

25. The system according to claim 16, wherein the pitch shifter shifts the pitch of the voice signal by one of increasing and decreasing the pitch of the voice signal.

26. The system according to claim 16, wherein the encoding section further comprises a vocoder, wherein the vocoder encodes the pitch-shifted voice signal and wherein the receiving unit comprises a vocoder for decoding the pitch-shifted voice signal.

27. The system according to claim 16, wherein the pitch analysis section further comprises a voiced/unvoiced detector, wherein the voiced/unvoiced detector detects at least one of a voiced and an unvoiced condition on the voice signal.

28. The system according to claim 16, wherein the encoding section comprises a vocoder, wherein the predetermined threshold is a compression window and wherein the predetermined range is between the maximum encoding pitch level and the minimum encoding pitch level of the vocoder.

29. The system according to claim 16, wherein the pitch shifter shifts the pitch of the voice signal from a first level to the portion of the predetermined range and wherein the receiving unit reshifts the pitch-shifted voice signal to a second level that is at least substantially equal to the first level.

30. A system for improving voice quality of a vocoder, comprising:

a pitch analysis section, wherein the pitch analysis section generates a pitch contour of a voice signal and monitors the pitch contour of the voice signal;

a pitch shifter coupled to the pitch analysis section, wherein when the pitch contour reaches a predetermined threshold, the pitch shifter shifts the pitch of the voice signal from a first level to at least a portion of a predetermined range;

an encoding section coupled to the pitch shifter, wherein the encoding block encodes the voice signal and provides pitch-shifting information in the voice signal; and a transmission section coupled to the encoding section, wherein the transmission section transmits the pitch-shifted voice signal to a receiving unit, wherein the receiving unit uses the pitch-shifting information to reshift the pitch-shifted voice signal to a second level, wherein the second level is at least substantially equal to the first level.

31. A machine readable storage, having stored thereon a computer program having a plurality of code sections executable by a portable computing device for causing the portable computing device to perform the steps of:

monitoring a pitch of a voice signal;

at a transmitting unit, when the pitch of the voice signal reaches a predetermined threshold, shifting the pitch of the voice signal to at least a portion of a predetermined range; and transmitting the pitch-shifted voice signal to a receiving unit;

wherein at the receiving unit, the pitch-shifted voice signal is reshifted to a level that compensates the step of shifting the pitch of the voice signal at the transmitting unit.

32. The machine readable storage according to claim 31, wherein the voice signal is comprised of a plurality of time-based frames and wherein the code sections further cause the portable computing device to perform the steps of:

estimating the pitch of the voice signal for at least a portion of the time-based frames of the voice signal; and based on the estimating step, generating a pitch contour of the voice signal.

33. The machine readable storage according to claim 31, wherein the code sections further cause the portable computing device to perform the steps of:

in the transmitting unit, detecting speech on the voice signal; and when detecting speech on the voice signal, determining whether the speech is comprised of voiced and unvoiced portions.

34. The machine readable storage according to claim 31, wherein if no speech is detected on the voice signal, the code sections further cause the portable computing device to perform the step of inserting at least one silence frame into the voice signal.

35. The machine readable storage according to claim 34, wherein the code sections further cause the portable computing device to perform the step of converting at least one of the silence frames to a pitch frame, wherein the pitch frames signal the receiving unit that the pitch-shifted voice signal was pitch shifted.

36. The machine readable storage according to claim 34, wherein the code sections further cause the portable computing device to perform the step of adding at least one pitch frame to the voice signal, wherein the pitch frames signal the receiving unit that the pitch-shifted voice signal was pitch shifted.

* * * * *